US010682879B2

(12) United States Patent
Erickson

(10) Patent No.: US 10,682,879 B2
(45) Date of Patent: Jun. 16, 2020

(54) MIRRORED FLUORESCENT SECURITY FEATURE

(71) Applicant: ASSA ABLOY AB, Stockholm (SE)

(72) Inventor: Brett Barton Erickson, San Jose, CA (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 15/766,537

(22) PCT Filed: Oct. 17, 2016

(86) PCT No.: PCT/IB2016/002008
§ 371 (c)(1),
(2) Date: Apr. 6, 2018

(87) PCT Pub. No.: WO2017/089901
PCT Pub. Date: Jun. 1, 2017

(65) Prior Publication Data

US 2019/0061408 A1 Feb. 28, 2019

Related U.S. Application Data

(60) Provisional application No. 62/242,031, filed on Oct. 15, 2015.

(51) Int. Cl.
*B42D 25/351* (2014.01)
*B42D 25/382* (2014.01)
(Continued)

(52) U.S. Cl.
CPC ..... *B42D 25/351* (2014.10); *B41M 3/144* (2013.01); *B42D 25/30* (2014.10); *B42D 25/328* (2014.10);
(Continued)

(58) Field of Classification Search
CPC ... B42D 25/351; B42D 25/382; B42D 25/387
See application file for complete search history.

(56) References Cited

U.S. PATENT DOCUMENTS 6,089,614 A * 7/2000 Howland ..... B42D 25/29 283/109
6,616,803 B1 * 9/2003 Isherwood ..... D21F 1/44 283/72

(Continued)

FOREIGN PATENT DOCUMENTS

EP 2028017 A2 * 2/2009 ..... B42D 25/29
EP 3362298 A2 8/2018
WO WO-2017089901 A2 6/2017

OTHER PUBLICATIONS

International Search Report issued by the European Patent Office for International Patent Application No. PCT/IB2016/002008, dated Jun. 30, 2017, 5 pages.

(Continued)

*Primary Examiner* — Kyle R Grabowski
(74) *Attorney, Agent, or Firm* — Schwegman Lundberg & Woessner, P.A.

(57) ABSTRACT

A credential with one or more security features is disclosed. The disclosed credential includes a windowed security feature. The windowed security feature is taught to include a mirror element positioned in proximity with a transparent window and a first photo-luminescent feature positioned relative to the transparent window and the mirror element such that the mirror element enhances a luminescence of the first photo-luminescent feature when viewed and illuminated through the transparent window.

20 Claims, 6 Drawing Sheets
(5 of 6 Drawing Sheet(s) Filed in Color)

(51) Int. Cl.

| | |
|---|---|
| ***B42D 25/387*** | (2014.01) |
| ***B41M 3/14*** | (2006.01) |
| ***B42D 25/36*** | (2014.01) |
| ***B42D 25/30*** | (2014.01) |
| ***B42D 25/328*** | (2014.01) |
| ***B42D 25/373*** | (2014.01) |

(52) U.S. Cl.
CPC ..... *B42D 25/36* (2014.10); *B42D 25/373* (2014.10); *B42D 25/382* (2014.10); *B42D 25/387* (2014.10)

(56) References Cited

U.S. PATENT DOCUMENTS

2006/0249951 A1 11/2006 Cruikshank et al.
2010/0047488 A1* 2/2010 Syrjanen ..... B42D 25/387 428/29
2011/0139024 A1 6/2011 Schiffmann
2012/0075701 A1 3/2012 Phillips et al.
2014/0319817 A1* 10/2014 Nikkila ..... B42D 25/351 283/85
2015/0129780 A1* 5/2015 Le Loarer ..... B42D 25/24 283/113
2016/0075164 A1* 3/2016 Sarrazin ..... B42D 25/351 283/94
2016/0333526 A1* 11/2016 MacPherson ..... B42D 25/387

OTHER PUBLICATIONS

Written Opinion issued by the European Patent Office for International Patent Application No. PCT/IB2016/002008, dated Jun. 30, 2017, 6 pages.
International Preliminary Report on Patentability for International (PCT) Patent Application No. PCT/IB2016/002008, dated Apr. 26, 2018 7 pages.
"European Application Serial No. 16847619.0, Response filed Dec. 7, 2018 to Communication pursuant to Rules 161(1) and 162 EPC dated Jun. 6, 2018", 6 pages.

* cited by examiner

MIRRORED FLUORESCENT SECURITY FEATURE

CROSS-REFERENCE TO RELATED APPLICATIONS

The present application is a national stage application under 35 U.S.C. 371 of PCT Application No. PCT/IB2016/002008, having an international filing date of Oct. 17, 2016, which designated the United States, which PCT application claimed the benefit of U.S. Provisional Patent Application No. 62/242,031, filed on Oct. 15, 2015, both of which are hereby incorporated herein by reference in their entirety.

FIELD OF THE DISCLOSURE

The present disclosure is generally directed toward security features and methods of incorporating security features into documents, credentials, passports, and other substrates.

BACKGROUND

The use of identification documents and other credentials is pervasive. Credentials are used on a daily basis for a number of different purposes. Credentials are most commonly used to prove identity, to verify age, to access an asset (e.g., secure area, financial account, computing resource, etc.), to evidence driving privileges, to cash a check, and so on. Airplane passengers are required to show a credential during check in, and sometimes at security screening and prior to boarding their flight. We also live in an ever-evolving cashless society where credentials are used to make payments, access an automated teller machine (ATM), debit an account, or make a payment, etc. Many industries require that their employees carry photo identification credentials on the job and to access various locations on a job site.

While many different types of security features have been developed to enhance the security associated with credentials, there is a growing desire for windowed credentials to include security features therein.

Prior art credentials 100, such as the one depicted in FIG. 1, include a laminated structure 104 having a windowed security feature 112 whose boundaries/edges are defined by one or more opaque portions 108 included in the laminated structure 104. Such known prior art credentials 100 include a photo-luminescent feature 116 within a viewing area of the windowed security feature 112. Additionally, prior art credentials 100 are known to include printed features 120 and other additional images 124 within the laminated structure 104. Unfortunately, the luminescence of the photo-luminescent feature 116 in the windowed security feature 112 is not optimal and the visibility of the photo-luminescent feature 116 when illuminated with light of a particular wavelength is not sufficient unless controlled lighting conditions exist (e.g., minimal surrounding/ambient light) for the person viewing the credential 100. This makes the overall utility of the windowed security feature 112 less desirable and utilized.

SUMMARY

It is, therefore, one aspect of the present disclosure to provide a credential with one or more security features. In particular, embodiments of the present disclosure provide a credential or document having a windowed security feature that includes at least one photo-luminescent feature (e.g., Ultraviolet (UV) fluorescent ink or Infrared (IR) photo-luminescent ink) and at least one mirror element that are viewable through the viewing area of the windowed security feature.

According to aspects of the present disclosure, one embodiment of such a credential comprises:

a transparent window;

a mirror element positioned in proximity with the transparent window; and a first photo-luminescent feature positioned relative to the transparent window and the mirror element such that the mirror element enhances a luminescence of the first photo-luminescent feature when viewed and illuminated through the transparent window.

According to other aspects of the present disclosure, the first photo-luminescent material is positioned in a view area of the transparent window.

According to other aspects of the present disclosure, the credential further includes a second photo-luminescent material that is different from the photo-luminescent material.

According to other aspects of the present disclosure, the mirror element is situated between the first photo-luminescent material and the second photo-luminescent material.

According to other aspects of the present disclosure, the first photo-luminescent material is visible through the transparent window when viewed from a first direction and the second photo-luminescent material is visible through the transparent window when viewed from a second direction that is different from the first direction.

According to other aspects of the present disclosure, the mirror element comprises a printed mirror.

According to other aspects of the present disclosure, the mirror element comprises at least one of metallic flakes or retro reflective beads.

According to other aspects of the present disclosure, the mirror element comprises an antenna.

According to other aspects of the present disclosure, the mirror element comprises a foil mirror.

According to other aspects of the present disclosure, the mirror element comprises a diffractive element.

According to other aspects of the present disclosure, the first photo-luminescent material comprises an ultraviolet visible ink.

According to other aspects of the present disclosure, the transparent window corresponds to an opening in an opaque layer of the secure document and the opening in the opaque layer aligns with the first photo-luminescent material and the mirror element.

According to other aspects of the present disclosure, the mirror element includes a predetermined shape that is visible through the transparent window when the first photo-luminescent material is illuminated with light of a predetermined wavelength.

According to other aspects of the present disclosure, the mirror element is provided on a separate layer of the secure document than the first photo-luminescent material.

The present disclosure will be further understood from the drawings and the following detailed description. Although this description sets forth specific details, it is understood that certain embodiments of the invention may be practiced without these specific details.

BRIEF DESCRIPTION OF THE DRAWINGS

The patent application file contains at least one drawing executed in color. Copies of this patent or patent application publication with color drawing(s) will be provided by the Office upon request and payment of the necessary fee.

DETAILED DESCRIPTION

Figure 1:
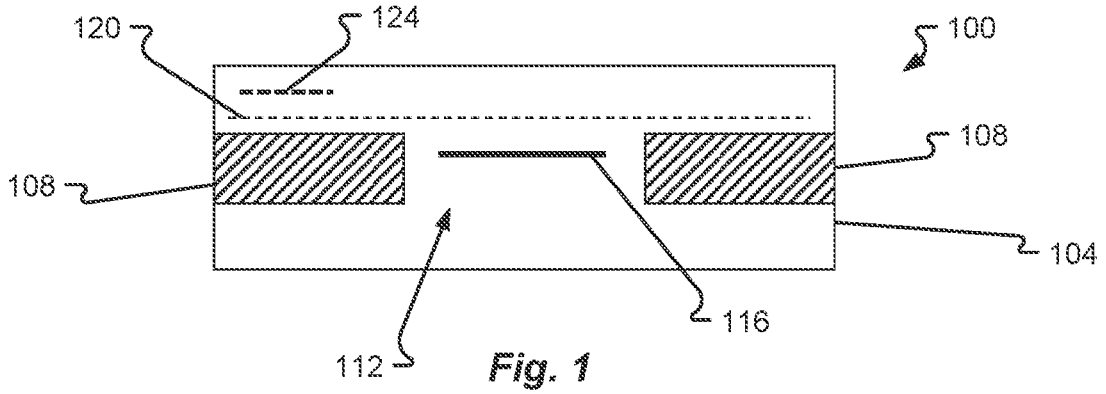
Fig. 1 (PRIOR ART)
FIG. 1 is a cross-sectional view of a prior art security credential.
Figure 2:
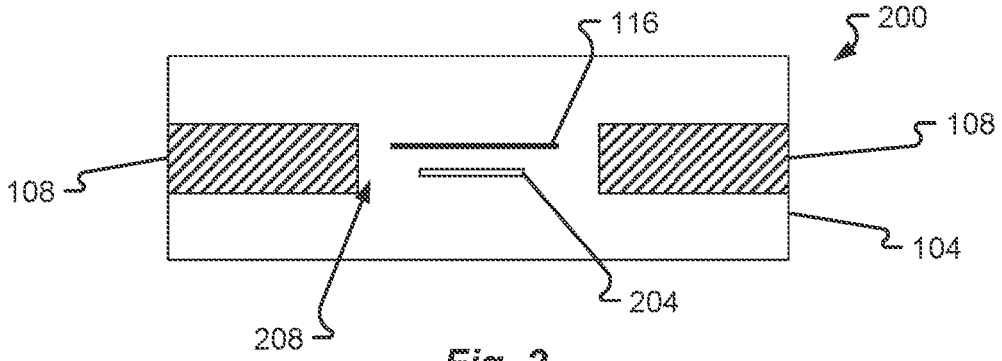
FIG. 2 is a cross-sectional view of a security document or credential according to aspects of the present disclosure.

With reference to FIG. 2, a first example of an improved credential 200 having an improved windowed security feature 208 is depicted in accordance with at least some embodiments of the present disclosure. The credential 200 is shown to include a laminated structure 104, which can include two or more layers of material that have been laminated together through one or more lamination processes. The laminated structure 104 includes one or more optically opaque portions 108 that are substantially opaque to light of a wavelength of interest of a band of wavelengths. For instance, the opaque portions 108 may be substantially non-transparent to visible light, UV light, IR light, and other forms of light around the visible light spectrum. A break or interruption in the opaque portions 108 creates a windowed feature 208 that enables a person or machine to view light of a wavelength of interest passing through the windowed security feature 208.

In the depicted embodiment, the improved windowed security feature 208 includes a mirror element 204 that is substantially proximal or adjacent to a photo-luminescent feature 116. In some embodiments, the mirror element 204 and photo-luminescent feature 116 are both contained within a viewing area or viewing window defined for the windowed security feature 208. In other words, a person or machine may view the photo-luminescent feature 116 and/or the mirror element 204 through the window of the windowed security feature 208.

In some embodiments, luminescence of the photo-luminescent feature 116 through the window 208 is improved/enhanced by the mirror element 204. In particular, when a user or machine views the photo-luminescent feature 116 from the top of the credential 200 and the photo-luminescent feature 116 is illuminated with light of a particular wavelength from the top of the credential 200, the luminescence of the photo-luminescent feature 116 is greatly improved/enhanced due to the mirror element 204 reflecting light passing through the window 208 back toward the photo-luminescent feature 116. Thus, the photo-luminescent feature 116 is illuminated with light that directly impacts the photo-luminescent feature 116 as well as light that passes by or through the photo-luminescent feature 116, and is reflected off the mirror element 208. This extra illumination by virtue of reflecting light back onto the photo-luminescent feature 116 helps to make the photo-luminescent feature 116 much more visible to an inspecting person or machine.

As shown in FIG. 2, the mirror element 204 and photo-luminescent feature 116 may both be positioned within the boundaries of the window feature 208 and, in particular, may be positioned within the laminate structure 104 such that both the photo-luminescent feature 116 and mirror element 204 do not extend above or below the opaque portions 108 of the laminated structure 104.

Figure 3:
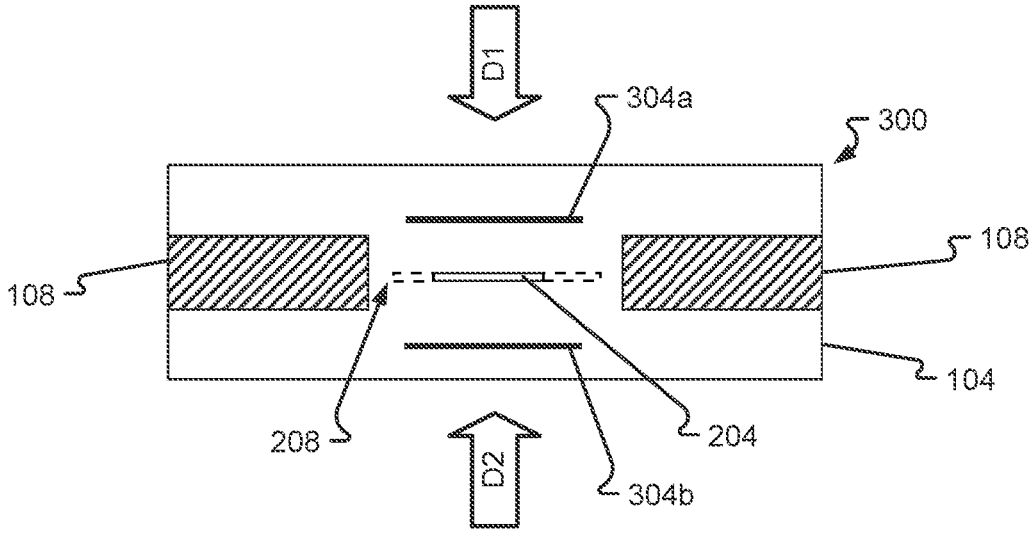
FIG. 3 is a cross-sectional view of a second credential according to aspects of the present disclosure.

As can be seen in FIG. 3, however, it is possible for a photo-luminescent feature 116 to be positioned above or below the opaque portions of the laminated structure 104. FIG. 3 also shows an embodiment of the present disclosure where there are two photo-luminescent features 304*a*, 304*b* provided in the laminated structure 104 and which are visible via the windowed security feature 208. In particular, the credential 300 of FIG. 3 includes a first photo-luminescent feature 304*a* and a second photo-luminescent feature 304*b* with a mirror element 204 sandwiched between the two. The mirror element 204 is shown to be positioned entirely within the opening of the opaque portions 108 that creates the window feature 208 whereas the photo-luminescent features 304*a*, 304*b* are positioned vertically within the window feature 208 but horizontally out of plane of the opening of the opaque portions 108. Thus, the photo-luminescent features 304*a*, 304*b* may be viewed from either a first viewing direction D1 or a second viewing direction D2 by a person or machine even though the photo-luminescent features 304*a*, 304*b* are not horizontally positioned within the opening of the opaque portions 108.

In some embodiments, the viewing window of the windowed security feature 208 is created by one or more cutouts, absences, vias, or openings in the opaque portions 108 when the opaque portions are laminated with other layers to create the laminated structure 104. Thus, depending upon the layer on which the photo-luminescent feature 304*a*, 304*b* and/or mirror element 204 are placed, the particular placement of the features 204, 304*a*, 304*b* may vary without departing from the scope of the present disclosure. Furthermore, as shown in FIG. 3, the area covered by the photo-luminescent features 304*a*, 304*b* may be greater than the area covered by the mirror element 204 (although the reverse situation may also be employed without departing from the scope of the present disclosure). In some embodiments, one or both of the photo-luminescent features 304*a*, 304*b* may extend through the entirety of a layer in the laminated structure 104. In some embodiments, the photo-luminescent features 304*a*, 304*b* may extend just beyond the opening of the window security feature 208.

Using the credential 300 of FIG. 3 as compared to the credential 200 of FIG. 2 may provide some additional benefits. As one example, if two photo-luminescent features 304*a*, 304*b* are used with a mirror element 204 therebetween, then viewing the credential 300 from a first viewing direction D1 may result in a first viewing experience whereas viewing the credential 300 from a second viewing direction D2 may result in a second viewing experience different from the first viewing experience. More specifically, when illuminated with light and when viewed from the first viewing direction D1, the mirror element 204 may substantially block light from impacting the second photo-luminescent feature 304*b*, which means that the luminescence of the first photo-luminescent feature 304*a* may be enhanced and be the primary visible feature. On the other hand, when illuminated with light and viewed from the second viewing direction D2, the mirror element 204 may substantially block light coming from the second viewing direction D2 from impacting the first photo-luminescent feature 304*a*. This may result in a viewing experience from the second viewing direction D2 where the second photo-luminescent feature 304*b* has its luminescence enhanced whereas the first photo-luminescent feature 304*a* is not visible through the window 208.

The viewing experience for the credential 200 of FIG. 2, however, may be different from the viewing experience of the credential 300. In particular, the viewing experience from the top of the credential 200 may result in an improved luminescence for the photo-luminescent feature 116 whereas the viewing experience from the bottom of the credential 200 (e.g., where illuminated light and a viewing party) will first see the mirror element 204 instead of the photo-luminescent feature 116, which may actually block visibility of the photo-luminescent feature 116.

In some embodiments, the photo-luminescent features 116, 304*a*, 304*b* may correspond to photo-luminescent or photo-reactive inks that are printed on one or more layers of the laminated structure 104. The inks may be UV fluorescent inks, IR fluorescent inks, or any other type of photo-reactive compound known in the art. In credentials using more than one photo-luminescent feature (e.g., credential 300), the photo-luminescent features 304*a*, 304*b* may be the same as one another or different from one another. For instance, when different types of photo-luminescent features 304*a*, 304*b* are utilized, a viewing experience of the window 208 from the first direction D1 will be substantially different from a viewing experience of the window 208 from the second direction D2. As an example, the first photo-luminescent feature 304*a* may correspond to UV fluorescent ink of a first color (e.g., red UV ink) whereas the second photo-luminescent feature 304*b* may correspond to a UV fluorescent ink of a second color (e.g., white UV ink).

The use of two different invisible UV-fluorescent inks for the features 304*a*, 304*b*, printed by offset lithography in different layers of the laminated structure 104 enables two different color emissions when the window is examined from the two different sides of the credential 300 (e.g., from the different viewing directions D1, D2). This effect is made much stronger when a mirror element 204 is provided (e.g., printed, stamped, etc.) between the two fluorescent printings. This mirror element 204, as discussed above, acts in 2 ways: (1) to boost the fluorescence from the print on the side being observed and (2) to block the fluorescence from the print on the other side.

In such embodiments, viewing the window 208 from the different viewing directions D1, D2 could give different fluorescent colors depending on which side of the window 208 was viewed and illuminated with a UV lamp (or IR light source).

In some embodiments, the mirror element 204 is a screen printed metallic or other reflective ink printed on one or more layers of the laminated structure 104 that separate the photo-luminescent features 304*a*, 304*b*. As discussed above, the area covered by the mirror element 204 may be at least as large as the area of the photo-luminescent features 304*a* and/or 304*b* and, in some embodiments, may be larger than the area covered by the photo-luminescent features 304*a* and/or 304*b*. In some embodiments, the area covered by the mirror element 204 is smaller than the opening which defines the window 208; however, if the mirror element 204 is provided above or below the window 208, then it may be possible to utilize a mirror element 204 that is larger in area than the opening which defines the window 208.

The mirror element 204 may manifest in a myriad of forms. For instance, the mirror element 204 may correspond to a reflective ink printed on one or more layers of the laminated structure 104 as discussed above. Other embodiments may utilize a printed mirror, for example metallic flakes or maybe retro-reflective beads. In other embodiments, a foil mirror (e.g., a vacuum deposited metal such as aluminum) is positioned behind/between the photo-luminescent features 304*a*, 304*b*. In still other embodiments, a diffractive element (e.g., a holographic feature or device) may be used as part of the mirror element 204 to separate the photo-luminescent features 304*a*, 304*b*. In still other embodiments, the mirror element 204 may include a reflective laser recordable media or plurality of media. In some embodiments, the mirror element 204 can have a shape to give a specific visual effect (e.g., star, circle, square, etc.). Accordingly, when one side or the other of the credential 200, 300 is illuminated, you will get different effects (because of the mirror being placed between the inks).

In some embodiments, the antenna of a smart card or contactless credential may be dual-purposed for use as the mirror element. In some embodiments, the antenna acting at the mirror element may correspond to ink that has been screen-printed onto the appropriate layer of the document. In some embodiments, the antenna may correspond to a wire antenna. It is anticipated, however, that an antenna formed from screen-printed ink may provide a better reflectivity of the light and create a better visual effect of the photo-luminescent material.

Figure 4A:
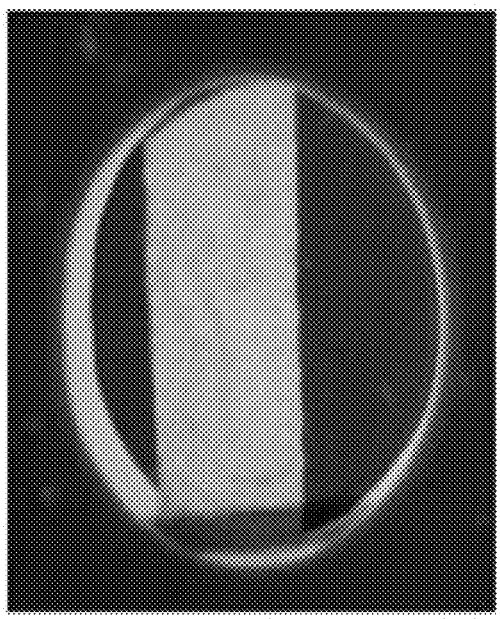
FIG. 4A is an image of the credential of FIG. 3, taken in the direction D1, showing the intensity of off-white UV ink for the photo-luminescent feature 304*a;*
Figure 4B:
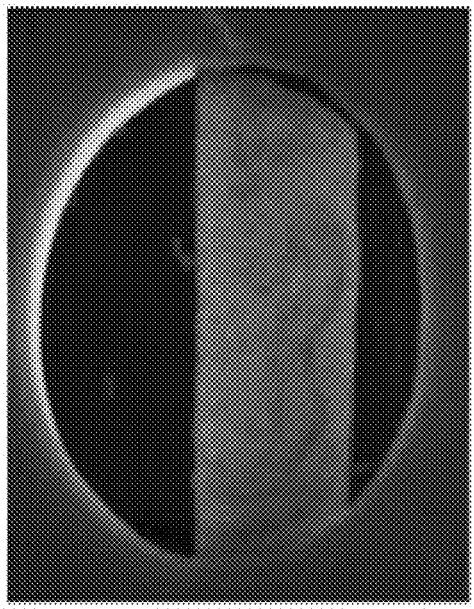
FIG. 4B is an image of the credential of FIG. 3, taken in the direction D2, showing the intensity of red UV ink for the photo-luminescent feature 304*b;*

Tests using red UV ink and off-white UV ink have been conducted using a credential construction similar to the credential 300 shown in FIG. 3. The intensity of the red and the off-white inks (for the photo-luminescent features 304*a*, 304*b*) was visible and the placement of a metallic layer (e.g., the mirror element 204) behind these inks greatly increased fluorescent intensity. Samples of this fluorescent metal sandwich were produced which showed an interesting asymmetric fluorescence (e.g., glowing yellow/white on one side when viewed from the first direction D1 where element 304*a* comprises the off-white UV ink, and red on the other side when viewed from the second direction D2 where element 304*b* comprises red UV ink) as shown in FIGS. 4A and 4B, respectively.

Figure 5:
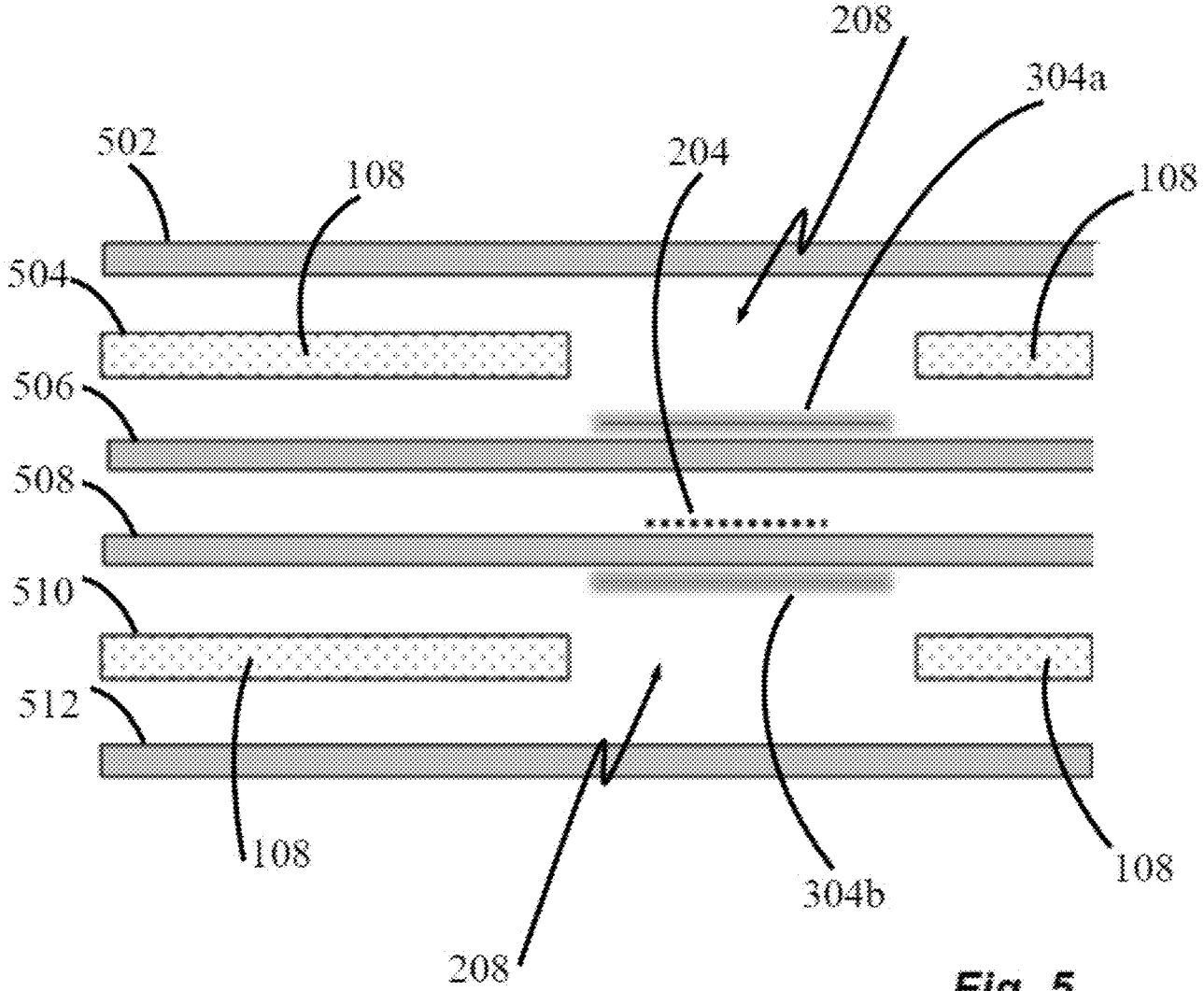
FIG. 5 is an exploded view illustrating the layers of a credential made according to aspects of the present disclosure.

FIG. 5 illustrates an example construction of layers that can be used to construct the laminated structure 104 of the credential 200 or 300. As illustrated, the top layer 502 is a clear laserable PC overlay. The next layer 504 is a white PC core sheet with a window 208 formed therein. The next layer 506 is a clear laserable PC with a discrete area 304*a* of UV ink. The next layer 508 is a clear laserable PC with an area 204 on one surface comprising a mirror element, for example a metallic ink, and an area 304*b* on the opposite surface comprising a UV ink. The next layer 510 is a white PC core sheet with a window 208 formed therein. The final or bottom layer 512 is a clear laserable PC overlay. The laminated structure 104 is formed as a result of applying heat and/or pressure to the various layers depicted in FIG. 5 for a predetermined amount of time. After lamination, the resulting credential, whether it be in the form of credential 300 as shown, in the form of a credential 200 or in some other form as disclosed herein, is obtained with a window 208 formed therein.

In the construction of FIG. 5, the photo-luminescent features 304*a*, 304*b* are provided on the outward-facing surfaces of the clear laserable PC layer 506 and the mirror element 204 can be provided on an inward-facing surface of one or both of the same layers having the features 304*a*, 304*b* printed thereon. As illustrated, mirror element 204 is on the inward surface of layer 508, but it could also be on the inward surface of layer 506. In other words, a single layer may have both photo-luminescent feature provided on one surface thereof (e.g., the outward-facing surface) and the mirror element 204 can be provided on an opposing surface thereof (e.g., the inward-facing surface). In other embodiments, the mirror element 204 can be provided as a metallic "shiny" ink that is printed on a layer sandwiched between the two layers having the photo-luminescent features 304*a*, 304) printed thereon. FIG. 5 is also useful to show that one or more layers in the laminated structure may comprise a cutout, hole, via, or gap in the opaque portion 108 (e.g., white PC-core sheet). This opening eventually becomes the window 208 through which a person or machine is able to view the security feature(s) described herein. Thus, while it may be useful to include one or more elements of the security feature (e.g., mirror element 204 and/or photo-luminescent feature 116, 304*a*, 304*b*) in line with the window, such a construction is not required.

In some embodiments, the combination of layers included in the eventual laminated structure 104 can be around 900 microns before lamination. It may be possible to offset print on thinner material to keep the overall thickness of the finished credential 200, 300 within ISO standards.

Figure 6A:
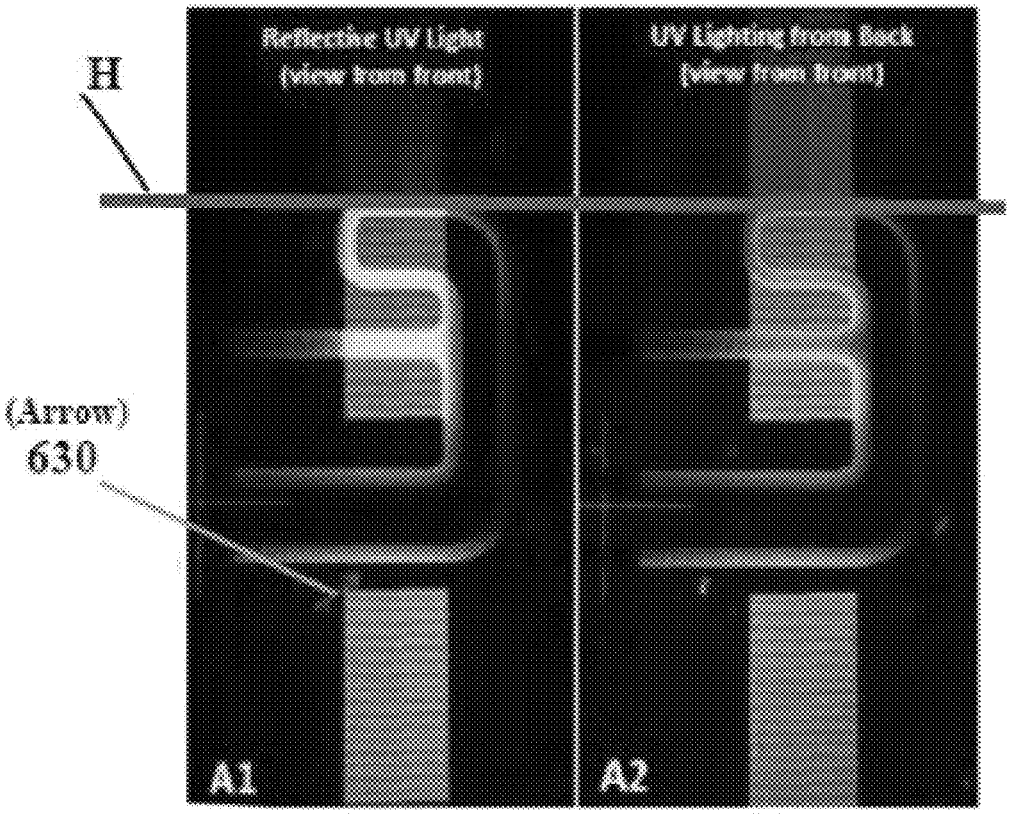
FIG. 6A is a first pair of images A1 and A2 of a credential according to aspects of the present disclosure where the credential includes a separation of 150 microns between the UV layer and the mirror element, as depicted in the exploded view of the credential below images A1 and A2.
Figure 6A:
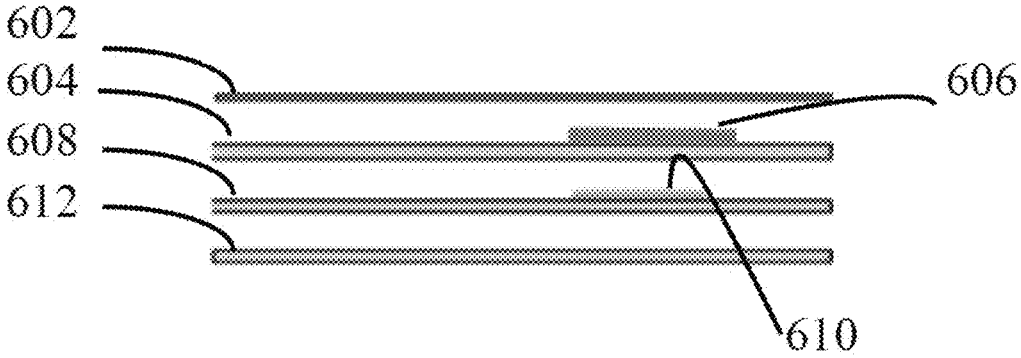

Additional trials have been conducted to see the effects of reflective fluorescence brilliance when additional PC materials are added between the photo-luminescent feature 116, 304*a*, 304*b* and the mirror element 204. A first example is illustrated in FIG. 6A where four layers were combined to form a structure with a 150-micron separation between the UV element and the mirror element. Specifically, a top layer 602 is a clear laserable PC layer that is 40 microns thick. The next layer 604 is a clear laserable PC layer that is 150 microns thick, and has an area 606 comprising green UV ink on its upper surface. The next layer 608 is a clear laserable PC layer that is 75 microns thick, and has an area 610 comprising a KSW metallic antenna on its upper surface. The final or bottom layer 612 is a clear laserable PC layer that is 100 microns thick. Image A1 in FIG. 6A illustrates fluorescent light reflectance when viewed from the front. Image A2 in FIG. 6A illustrate fluorescent light reflectance when the structure is lighted from the back and viewed from the front.

Figure 6B:
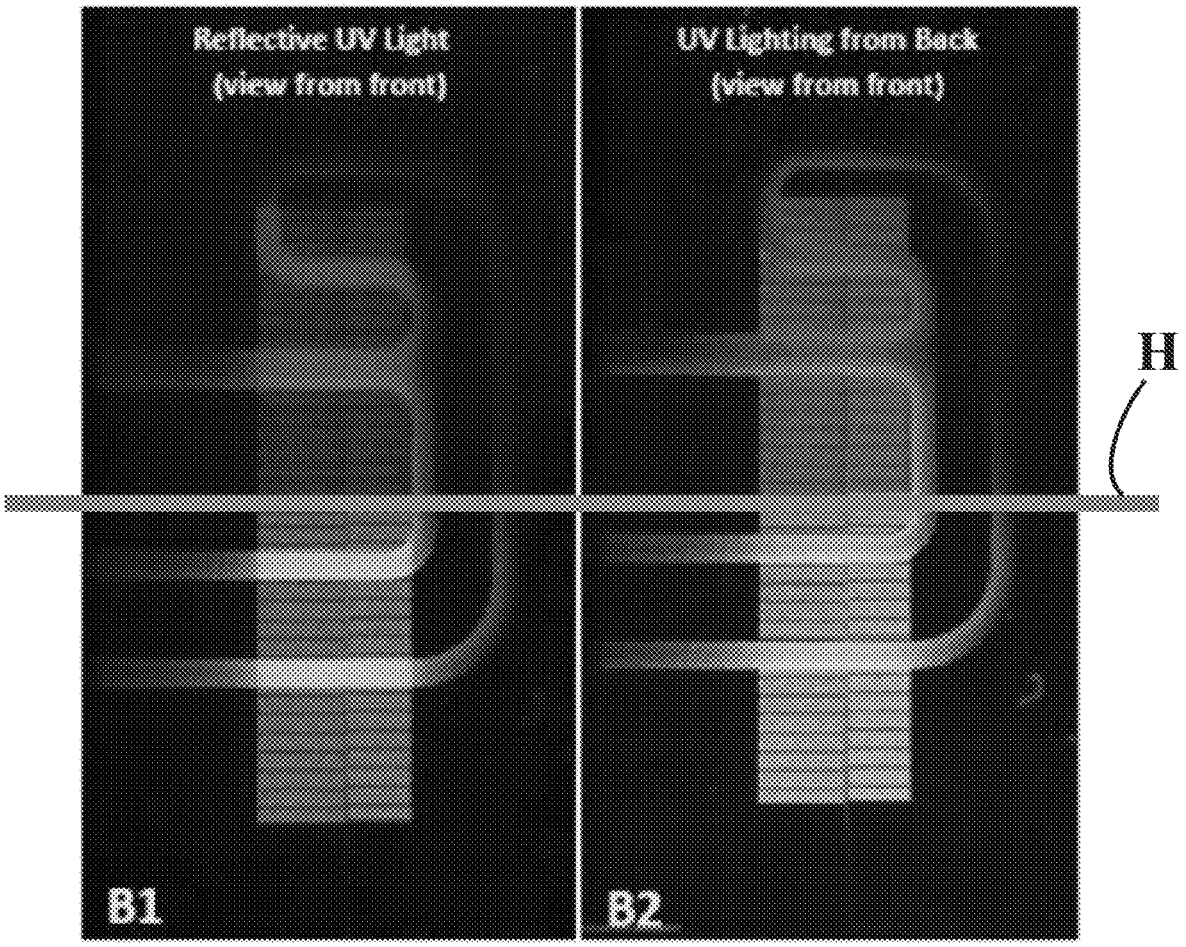
FIG. 6B is a second pair of images B1 and B2 of a credential according to aspects of the present disclosure where the credential includes a separation of 450 microns between the UV layer and the mirror element, as depicted in the exploded view of the credential below images B1 and B2.
Figure 6B:
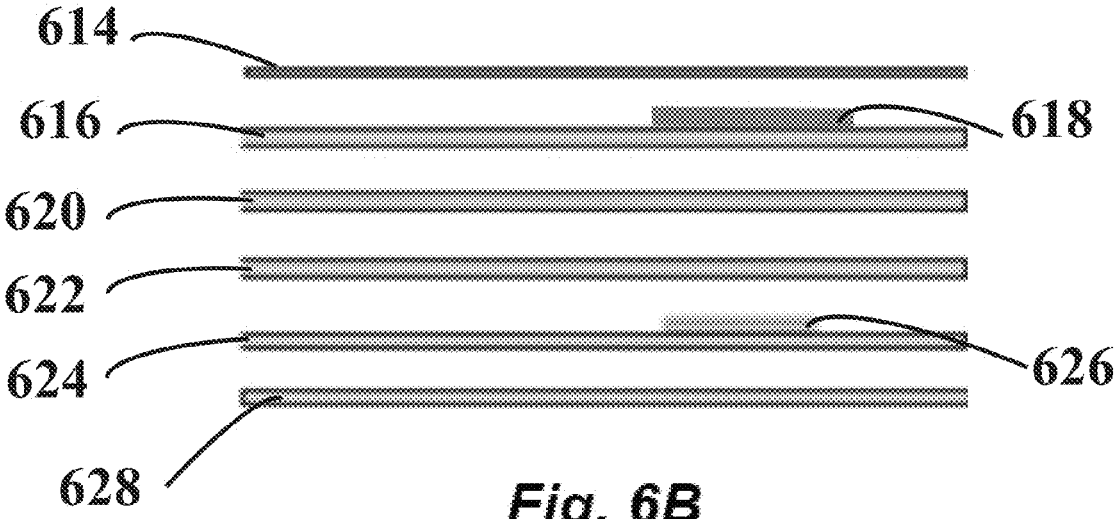

A second example is illustrated in FIG. 6B where six layers were combined to from a structure with a 450-micron separation between the UV element and the mirror element. Specifically, a top layer 614 is a clear laserable PC layer that is 40 microns thick. The next layer 616 is a clear laserable PC layer that is 150 microns thick, and has an area 618 comprising green UV ink on its upper surface. The next layer 620 is a clear laserable PC layer that is 150 microns thick. The next layer 622 is a clear laserable PC layer that is 150 microns thick. The next layer 624 is a clear laserable PC layer that is 75 microns thick, and has an area 626 comprising a KSW metallic antenna on its upper surface. The final or bottom layer 628 is a clear laserable PC layer that is 100 microns thick. Image B1 in FIG. 6B illustrates fluorescent light reflectance when viewed from the front. Image B2 in FIG. 6B illustrate fluorescent light reflectance when the structure is lighted from the back and viewed from the front.

Figure 7:
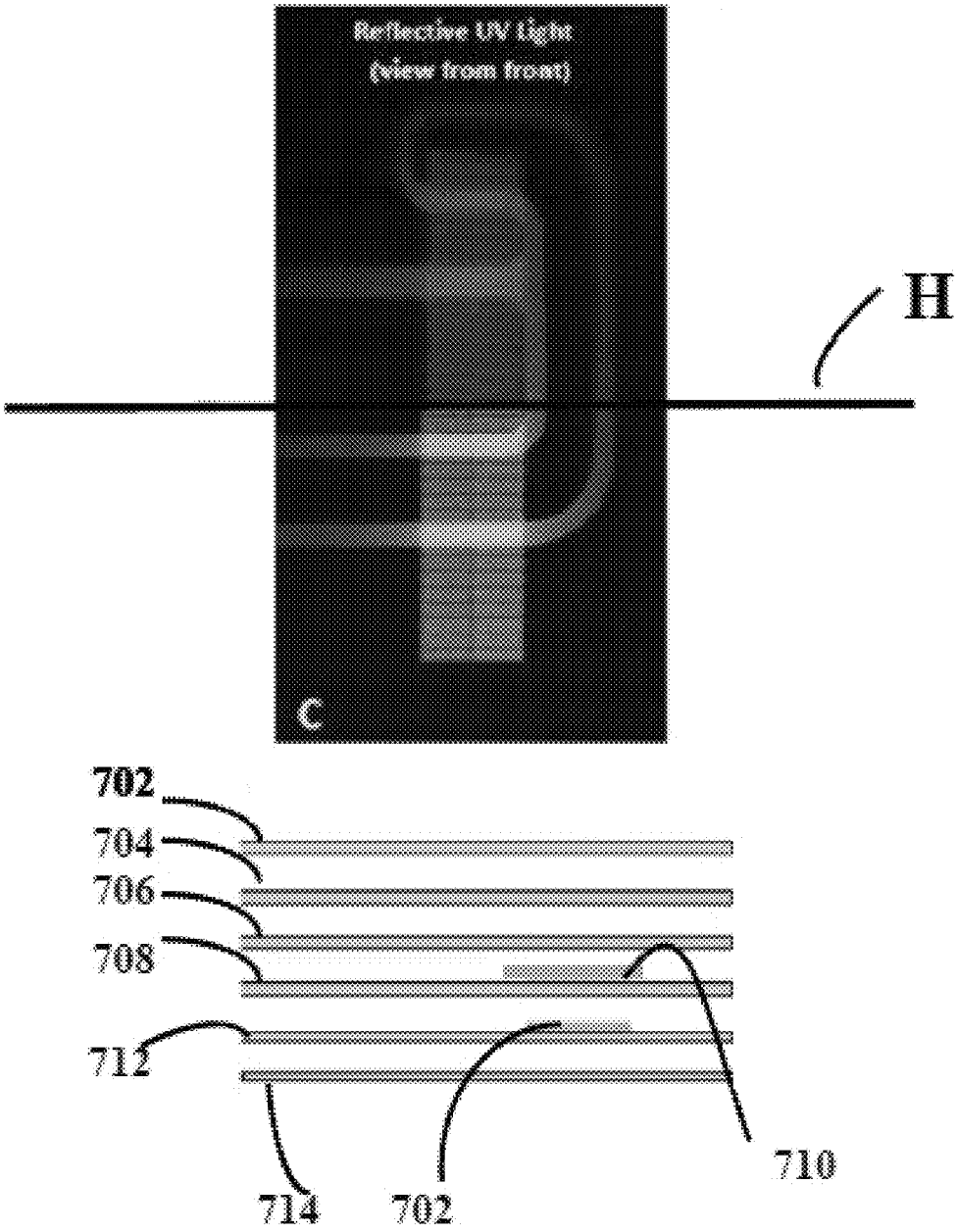
FIG. 7 is an image of a credential according to aspects of the present disclosure where the credential includes a separation of 500 microns between the mirror element and the outer surface of the credential.

A further trial was conducted to see the effects of reflective fluorescence brilliance when the photo-luminescent feature 116, 304*a*, 304*b* and the mirror element 204 were moved farther from the outer or top surface of the structure. FIG. 7 illustrates this third trial. Specifically, top layer 702 is a clear laserable PC layer that is 100 microns thick. The next layer 704 is a clear laserable PC layer that is 100 microns thick. The next layer 706 is a clear laserable PC layer that is 150 microns thick. The next layer 708 is a clear laserable PC layer that is 150 microns thick, and has an area 710 comprising green UV ink on its upper surface. The next layer 712 is a clear laserable PC layer that is 75 microns thick, and has an area 714 comprising a KSW metallic antenna on its upper surface. The final or bottom layer 716 is a clear laserable PC layer that is 100 microns thick.

As seen in FIGS. 6A, 6B and 7, the fluorescent light reflectance was almost reduced by 50% when an extra separation of 300 microns of clear PC was added, however, the backlit performance was increased when the UV light was shown from the backside. The arrow 630 in image A1 of FIG. 6A depicts an interesting effect that the adjacent UV ink has lit the edge of the mirror element 204. In both cases, the UV lighting from the back helped to improve the brightness of the blue UV. The blue UV zone is above the horizontal line H shown in images A1 and A2 of FIG. 6*a*, images B1 and B2 of FIG. 6B and image C of FIG. 7. The zone below the horizontal line is a green UV.

Referring again to the structure of FIG. 7, the mirror and UV printing were placed in the same close configuration as sample A1 in FIG. 6A that gave the best performance results. Image B1 in FIG. 6B compares the difference in performance when the UV is 450μ away from the mirror and, as shown in FIG. 7, when the UV is 500μ away from the surface. Image C in FIG. 7 appears to have the least amount of fluorescence reflecting back of all samples due to the 500μ layer of PC material in which the UV light must pass and reflect back. It should be appreciated that the photos of FIGS. 4, 6A, 6B and 7 are for exemplary reference only as exposures and lighting conditions may vary from each sample.

In some embodiments, three different inks were obtained from SICPA, emitting red, "white" and blue under 365 nm illumination. These inks were specified to be printable by wet offset onto polycarbonate, to be UV-curable and suitable for lamination.

Simplified structures of the PRC structure (shown above) were used to test the principles of UV-fluorescent windows. In some embodiments, there is the ability to use a metallic print, sandwiched between the UV-fluoro prints. A card was assembled with UV fluorescence in the window, and found to exhibit much brighter fluorescence when positioned over a metallic antenna layer. In some embodiments, the metal layer might acts as a mirror element, enhancing the intensity of the fluorescence, and also as an opaque layer, enabling different fluorescent colors to show when viewing different faces of the window.

While illustrative embodiments of the disclosure have been described in detail herein, it is to be understood that the inventive concepts may be otherwise variously embodied and employed, and that the appended claims are intended to be construed to include such variations, except as limited by the prior art.

What is claimed is:

1. A secure document comprising:

a first opaque layer having a first transparent window formed therein;

a first clear layer adjacent to a first side of the first opaque layer;

one or more second clear layers adjacent to a second side of the first opaque layer;

a mirror element on a first surface of one of the second clear layers and having at least a portion thereof that is aligned with the first transparent window; and a first photo-luminescent feature on a second surface of one of the second clear layers and having at least a portion thereof that is aligned with the first transparent window and the mirror element;

wherein a distance between the mirror element and the first photo-luminescent feature is at least 300 microns; and wherein when the first transparent window is illuminated with light from a first side of the secure document, such light is reflected by the mirror element toward the first photo-luminescent feature such that the mirror element enhances a luminescence of the first photo-luminescent feature in an area of the first photo-luminescent feature aligned with the mirror element and when the first transparent window is illuminated with light from a second side of the secure document, such light is substantially inhibited by the mirror element from impacting the first photo-luminescent feature in the area of the first photo-luminescent feature aligned with the mirror element.

2. The secure document of claim 1, wherein the mirror element comprises at least one of a printed mirror, metallic flakes, retro reflective beads, an antenna, a foil mirror and a diffractive element.

3. The secure document of claim 2, wherein the mirror element comprises an antenna.

4. The secure document of claim 1, wherein when the first transparent window is illuminated with light, the light emanating from the first side of the secure document includes luminescence from the first photo-luminescent feature and light reflected from the mirror element.

5. The secure document of claim 1, wherein an area of the mirror element is smaller than an area of the first transparent window.

6. The secure document of claim 1, wherein an area of the mirror element is larger than an area of the first transparent window.

7. The secure document of claim 1, wherein the first photo-luminescent feature comprises at least one of an ultraviolet ink and an infrared ink.

8. The secure document of claim 1, wherein the mirror element comprises a predetermined shape that is visible through the first transparent window when the first photo-luminescent feature is illuminated with light of a predetermined wavelength.

9. The secure document of claim 1, wherein the first surface is on a separate one of the second clear layers of the secure document than the second surface.

10. The secure document of claim 1, further comprising:

a second opaque layer adjacent to the one or more second clear layers, the second opaque layer having a second transparent window formed therein aligned with the first transparent window; and a third clear layer adjacent to a side of the second opaque layer opposite the one or more second clear layers.

11. The secure document of claim 10, wherein the one or more second clear layers comprises at least two clear layers and further comprising a second photo-luminescent feature on a third surface of one of the second clear layers and having at least a portion thereof that is aligned with the first transparent window, wherein the mirror element is situated between the first photo-luminescent feature and the second photo-luminescent feature.

12. The secure document of claim 11, wherein when the first transparent window is illuminated with light, the light emanating from the first side of the secure document is different from the light emanating from the second side of the secure document.

13. The secure document of claim 12, wherein the first photo-luminescent feature is visible through the first transparent window when viewed from the first side of the secure document and wherein the second photo-luminescent feature is visible through the second transparent window when viewed from the second side of the secure document.

14. The secure document of claim 1, wherein the first surface and second surface are on opposite sides of one of the second clear layers.

15. The secure document of claim 1, wherein the first opaque layer is polycarbonate.

16. The secure document of claim 15, wherein the clear layers comprise clear laserable polycarbonate.

17. The secure document of claim 1, wherein the at least 300 microns distance between the mirror element and the first photo-luminescent feature comprises clear polycarbonate.

18. A laminated secure document formed by laminating, by the application of at least one of heat or pressure, the secure document of claim 1.

19. A secure document comprising:

a first opaque layer having a first transparent window formed therein;

a first clear layer adjacent to a first side of the first opaque layer;

one or more second clear layers adjacent to a second side of the first opaque layer;

a mirror element on a first surface of one of the second clear layers and having at least a portion thereof that is aligned with the first transparent window; and a first photo-luminescent feature on a second surface of one of the second clear layers and having at least a portion thereof that is aligned with the first transparent window and the mirror element;

wherein a distance between the mirror element and the first photo-luminescent feature is at least 300 microns.

20. The secure document of claim 19, wherein the one or more second clear layers comprises at least two clear layers further comprising:

a second photo-luminescent feature on a third surface of one of the second clear layers and having at least a portion thereof that is aligned with the first transparent window, wherein the mirror element is situated between the first photo-luminescent feature and the second photo-luminescent feature;

a second opaque layer adjacent to the second clear layers, the second opaque layer having a second transparent window formed therein aligned with the first transparent window; and a third clear layer adjacent to a side of the second opaque layer opposite the second clear layers.

* * * * *